United States Patent [19]

Donaldson et al.

[11] 4,411,618

[45] Oct. 25, 1983

[54] DOWNHOLE STEAM GENERATOR WITH IMPROVED PREHEATING/COOLING FEATURES

[75] Inventors: A. Burl Donaldson; Donald E. Hoke,

[73] Assignee: The United States of America as represented by the U.S. Department of Energy, Washington, D.C.

[21] Appl. No.: 195,966

[22] Filed: Oct. 10, 1980

[51] Int. Cl.[3] ..... F23L 7/00; E21B 43/00

[52] U.S. Cl. ..... 431/190; 431/158; 431/243; 166/59

[58] Field of Search ..... 431/158, 242, 243, 353, 431/190; 60/39.55, 730, 736; 166/59, 303; 175/14

[56] References Cited

U.S. PATENT DOCUMENTS

| | | | |
|---|---|---|---|
| 1,562,333 | 11/1925 | Johnson | 60/39.55 |
| 2,359,108 | 9/1944 | Hoskins | 60/730 |
| 2,916,877 | 12/1959 | Walter | 60/730 |
| 3,980,137 | 9/1976 | Gray | 166/303 |
| 4,211,071 | 7/1980 | Wyatt | 60/39.55 |

FOREIGN PATENT DOCUMENTS

| | | | |
|---|---|---|---|
| 1387724 | 3/1975 | United Kingdom | 431/243 |

*Primary Examiner*—Lee E. Barrett

*Attorney, Agent, or Firm*—James H. Chafin; Albert Sopp; Richard G. Besha

[57] ABSTRACT

An apparatus for downhole steam generation employing dual-stage preheaters for liquid fuel and for the water. A first heat exchange jacket for the fuel surrounds the fuel/oxidant mixing section of the combustor assembly downstream of the fuel nozzle and contacts the top of the combustor unit of the combustor assembly, thereby receiving heat directly from the combustion of the fuel/oxidant. A second stage heat exchange jacket surrounds an upper portion of the oxidant supply line adjacent the fuel nozzle receiving further heat from the compression heat which results from pressurization of the oxidant. The combustor unit includes an inner combustor sleeve whose inner wall defines the combustion zone. The inner combustor sleeve is surrounded by two concentric water channels, one defined by the space between the inner combustor sleeve and an intermediate sleeve, and the second defined by the space between the intermediate sleeve and an outer cylindrical housing. The channels are connected by an annular passage adjacent the top of the combustor assembly and the countercurrent nature of the water flow provides efficient cooling of the inner combustor sleeve. An annular water ejector with a plurality of nozzles is provided to direct water downwardly into the combustor unit at the boundary of the combustion zone and along the lower section of the intermediate sleeve.

3 Claims, 3 Drawing Figures

DOWNHOLE STEAM GENERATOR WITH IMPROVED PREHEATING/COOLING FEATURES

The U.S. Government has rights in this invention pursuant to Contract No. DE-AC04-76DP00789 and modifications between the U.S. Department of Energy and Western Electric Company, Incorporated.

BACKGROUND OF THE INVENTION

The invention is in the area of tertiary oil recovery techniques, in particular, an improved apparatus for downhole injection of steam into boreholes.

In the art of recovering oil from earth formations, tertiary methods are increasing in their importance. Initially, oil flow from many wells is driven by the pressure due to natural gases trapped along with the liquid oil in the formation. With the passage of time, natural gas pressures decrease. When gas pressure is insufficient to drive oil to the surface, pumping methods are then employed. As time passes, pumping methods may be ineffective because the flow of oil underground out of porous formations into a well may be very slow. It is at this point that tertiary methods are sought to accelerate the flow of oil from the formation into the well. A particularly useful tertiary method employs the injection of steam. Steam serves to heat the oil in the formation, thereby reducing its viscosity and increasing its flow rate into the well for recovery.

Methods employing downhole generation of steam within a well have proved to be particularly advantageous. The prior art discloses several representative methods and apparatus.

In U.S. Pat. No. 3,456,721, Smith discloses a downhole burner for generating steam. Gaseous or liquid fuels are mixed with air and combusted in a burner with simultaneous spraying of water toward the flame. The water is sprayed from a cylindrical water jacket through a plurality of orifices. Steam is formed by the vaporization of the water as the water bombards the flame.

In U.S. Pat. No. 3,980,137, Gray discloses a downhole steam injector employing the combustion of hydrogen with oxygen to generate heat to vaporize injected water to form steam. The water moves through an annular jacket surrounding the combustion chamber and, after being preheated, enters the combustion chamber through plurality of grooves or passages at the top of the combustion chamber near the ignitor and the hydrogen/oxygen flame.

Hamrick and Rose in their related U.S. Pat. Nos. 3,982,591 and 4,078,613 disclose downhole steam generators. In the first patent, in FIG. 17, water is injected through a plurality of apertures directly into the flame in a hydrogen/oxygen combustion zone. In the second patent, in FIG. 2B, water moves into a cooling annulus before it is injected into a mixing zone spaced below the combustion zone. The mixing zone is defined by a cylindrical wall which has a plurality of apertures through which water from the cooling annulus passes laterally into the mixing zone. A heat-resistant liner is placed along the interior of the combustion zone.

In the latter patent, methane is burned in oxygen in two stages to reduce the formation of soot. Firstly, gaseous methane is compressed, carried down into the borehole and reacted with oxygen in a controlled manner to form carbon monoxide and hydrogen. Subsequently, carbon monoxide and hydrogen are reacted with oxygen toform carbon dioxide and water.

Several problems have been encountered with these prior art downhole steam generators. A particularly dangerous problem relates to burnback; that is when the combustion zone extends back into the precombustion area. Burnback is caused by several contributing factors which include: overheating of the boundary layer adjacent the inner wall of the precombustion zone; a boundary layer which is thick and of low velocity; and thermal conduction from the combustion zone to precombustion areas.

Another problem with the prior art downhole steam generators is the tendency of the flame in the combustor to be quenched by water injected directly into the flame.

An additional problem related to the direct injection of water into the combustion zone is wetting the sparkplug or ignitor, thereby reducing the efficiency of combustion.

A problem related to inefficient combustion is the formation of soot. Soot has two deleterious effects. One is air pollution, and the other is the tendency to clog the pores in the earth formation, thereby impeding oil flow out of the formation into the production well.

The disclosure of suitable fuel forms in the prior art is limited to fuels which are: high pressure fluids which are gases at ambient temperature; and liquids which are atomized prior to burning. Absent from this list are liquid fuels which are in the liquid state at high pressure and ambient temperature and which are gaseous at high pressure and elevated temperature conditions. Pressurization of gases requires elaborate equipment which is not necessary when employing a liquid fuel.

Another problem prevalent with the prior art devices employing heat resistant combustion zone liners is that the liners are not cooled adequately by adjacent heat transfer jackets. As a consequence, the liners cannot withstand the prolonged high temperatures of the combustion zone and undergo severe deterioration.

SUMMARY OF THE INVENTION

In view of the deficiencies and inadequacies described above, it is an object of the invention to provide an apparatus for downhole steam generation which reduces the tendency of burnback from the combustion zone to precombustion areas.

More particularly, an object of the invention is to provide an apparatus for efficiently cooling the boundary layer adjacent the inner wall of the combustion zone and for reducing the thickness and increasing the velocity of the boundary layer.

Another object of the invention is to provide an apparatus for reducing thermal conduction to precombustion areas of the oxidant supply.

Another object of the invention is to provide an apparatus for employing liquid fuels which are liquid under pressurized and ambient temperature conditions and are gaseous under elevated temperature conditions.

An additional object of the invention is to provide an apparatus for deep hole steam generation which precludes quenching of the combustion flame by injected water.

Yet another object of the apparatus of downhole steam generation of the invention is to prevent wetting the plug or ignitor so as to preclude inefficient combustion.

Still another object of the invention is to provide a downhole steam generation apparatus which prevents formation of soot and attendant pollution.

Another object of the invention is to provide an apparatus of downhole steam generation in which the walls of the combustion zone are cooled adequately to preclude deterioration of the combustion zone wall.

Additional objects, advantages, and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purposes of the present invention as described herein, an apparatus for downhole steam generation is described including an oxidant supply; a combustor assembly having a fuel/oxidant mixing section and a combustor unit; a fuel supply connected to the fuel/oxidant mixing section, the fuel supply having a dual-stage preheater including a first heat exchange jacket surrounding the fuel/oxidant mixing section and placed in contact with the combustor unit, and a second heat exchange jacket placed around a portion of the oxidant supply. The first and second heat exchange jackets serve both to preheat and vaporize the liquid fuel for more efficient combustion and to cool these precombustion areas, in order to prevent deleterious burnback.

A suitable liquid fuel for use with the apparatus of the present invention is propane, although it is to be understood that other fuels with like properties may be used in accordance with the broadest aspects of the present invention. An ignitor is provided for ignition of the fuel and oxidant mixture in the combustion zone. A water supply is connected to the combustor unit in which injected water is flashconverted to steam upon absorption of the heat of combustion.

In a further aspect of the present invention, in accordance with its objects and purposes, the apparatus for downhole steam generation includes a combustor unit which includes an inner combustor sleeve having an inner wall defining the combustion zone; an intermediate sleeve spaced concentrically with respect to the inner combustor sleeve, wherein the space between the two sleeves is connected to the inlet water supply and defines an annular water flow channel for the inner combustor sleeve. The intermediate sleeve has a portion extending below the inner combustor sleeve. The extending portion has an inner wall which defines a steam generating zone in the combustor unit. An annular water ejector is placed adjacent the intermediate sleeve and the inner combustor sleeve. The water ejector has a plurality of nozzles for ejecting water downwardly into the boundary of the combustion zone.

Preferably, in addition, a cylindrical housing sleeve is provided which is spaced concentrically with respect to the intermediate sleeve. The space between the cylindrical housing sleeve and the intermediate sleeve is also connected to the water supply and defines an annular water flow channel for the inner combustor sleeve. An annular passage connects the concentric flow channels. Together, the upward and downward flows of water through the water channels serve to cool the inner combustor sleeve and preheat the water used to generate the steam.

The provision of cooling of the inner combustor sleeve with the steam generating zone below the sleeve is a significant improvement in combustion zone cooling for downhole steam generators which provides efficient and uniform cooling of the inner combustor sleeve from top to bottom. Thus, quenching of the flame is significantly reduced.

Preferably, for preheating the fuel, the first heat exchange jacket contacts the combustor unit deriving heat directly from the heat of combustion of the fuel and oxidant. Afterward, the fuel is passed through the second heat exchange surrounding a portion of the oxidant supply deriving heat from the compression heat of the oxidant. The oxidant, preferably air, undergoes significant heating when it is compressed. Some of this heat is thus used to preheat the liquid fuel.

By employing the apparatus of the invention, numerous benefits and advantages are obtained. By providing efficient cooling of the boundary layer, the tendency of burnback from the combustion zone to precombustion areas is significantly reduced. Efficient cooling also reduces thermal conduction from the combustion zone to precombustion areas of the oxidant supply means. By employing heat exchangers for preheating liquid fuels, use of liquid fuels, such as liquid propane (liquid under pressurized and ambient temperature conditions), is practical. The propane is vaporized before ignition and burns cleanly and completely in the combustion zone. The fuel preheaters also serve to further remove heat from the mixer unit, thereby cooling it and reducing the tendency of burnback.

As briefly mentioned above, by employing the inner combustor sleeve of the invention, quenching of the combustion flame by injection of water for steam formation is prevented. The inner combustor sleeve also serves to prevent wetting the sparkplug or other ignitor thereby precluding inefficient combustion. By employing the annular water injector of the invention, placed adjacent the intermediate sleeve and the lower end of the inner combustor sleeve, water is ejected downwardly into the steam generating zone of the combustor unit. Thus, steam is generated at the boundary between the combustion zone and the steam generating zone allowing combustion to be complete. As a consequence the apparatus of the invention prevents incomplete comcombustion of the fuel and oxidant, thus preventing deleterious soot formation. By employing the countercurrent cooling of the inner combustion sleeve by means of the two water channels connected in series, efficient direct cooling of the sleeve is obtained thereby preventing deterioration of the sleeve.

Still other objects and advantages of the present invention will become readily apparent to those skilled in this art from the following detailed description, wherein we have shown and described only the preferred embodiment of the invention, simply by way of illustration of the best modes contemplated for carrying out the invention. As will be realized, the invention is capable of other and different embodiments, and its several details are capable of modification in various, obvious respects, all without departing from the invention. Accordingly, the drawings and description are to be regarded as illustrative in nature, and not as restrictive.

BRIEF DESCRIPTION OF THE DRAWINGS

The accompanying drawings, which are incorporated in and form a part of this specification, illustrate several aspects of the present invention, and, together with the description, serve to explain the principles of the invention. In the drawings.

DETAILED DESCRIPTION OF THE INVENTION

Figure 1:
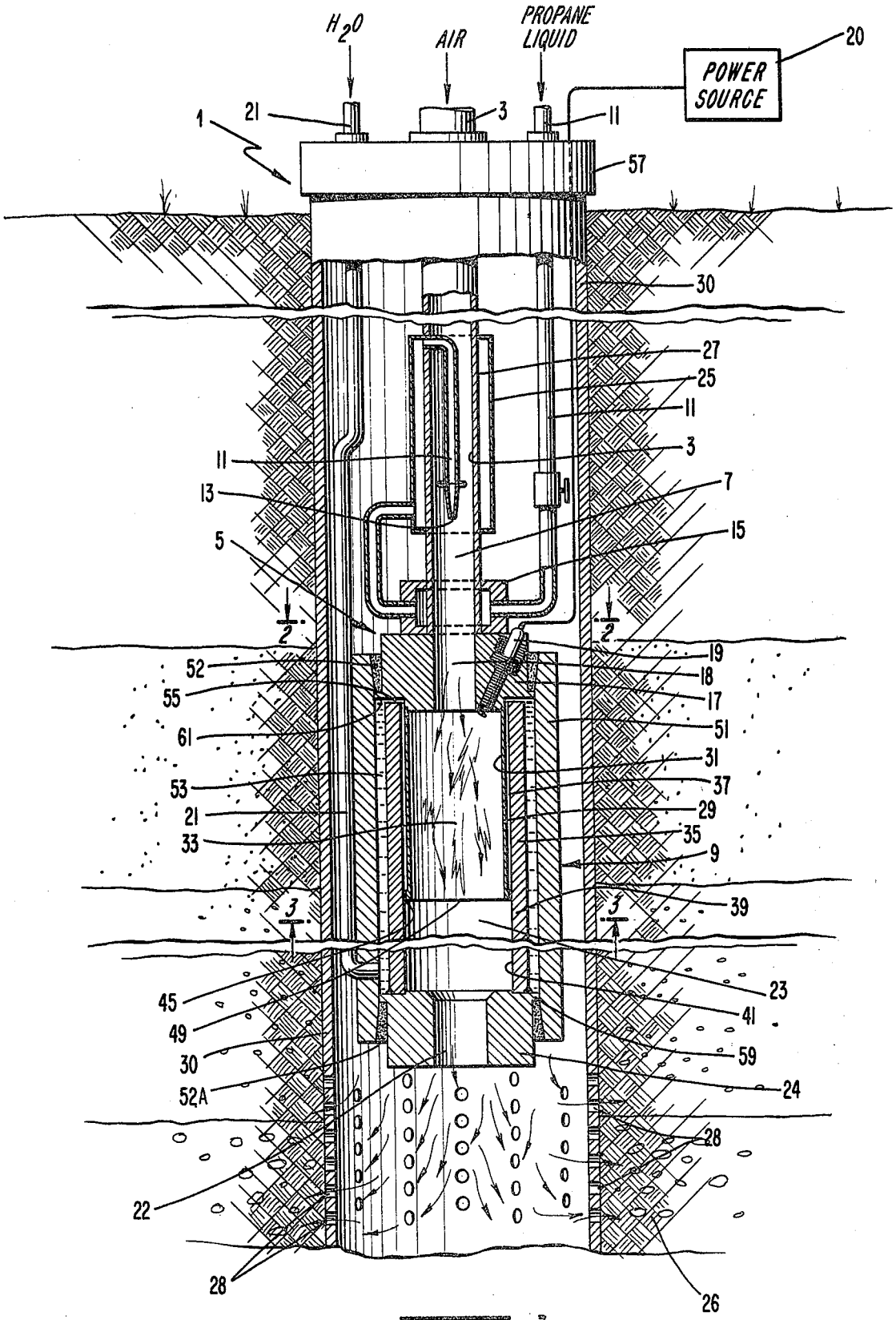
FIG. 1 is a side view partially broken away and partially in longitudinal cross-section of a steam generator apparatus of the invention in place in a borehole.

With reference to FIG. 1, in accordance with the invention, the apparatus for downhole steam generation 1 comprises: an oxidant supply line 3; a combustor assembly 5 having a fuel/oxidant mixing section 7 and a combustor unit 9. Assembly 5 is connected to oxidant supply line 3. Fuel supply line 11 is in fluid communication with the fuel/oxidant mixing section 7 through nozzle 13.

The fuel supply line 11 has dual-stage preheater comprising a first heat exchange jacket or preheater 15 surrounding the fuel/oxidant mixing section 7 and directly contacting combustor unit 9 by engagement with top cap 17. Heat of combustion is conducted through top cap 17 to the fuel in the jacket 15.

Power source 20 supplies power for an ignitor 19, such as a glow plug, for igniting the fuel and oxidant mixture in the combustor unit 9. A water supply line 21 is connected to the combustor unit 9 for providing water which, upon being heated, flashes to steam in steam generating zone 23 of combustor unit 9. Steam emerges from outlet nozzle 22 in bottom cap 24 to penetrate earth formation 26 through perforations 28 in a well casing 30.

The second stage of the fuel preheater includes a second jacket 25 surrounding portion 27 of oxidant supply line 3 adjacent fuel nozzle 13, thereby providing heat conduction from the oxidant supply line 3 to the fuel. Heat passing from the oxidant supply line 3 through jacket 25 to the fuel is partially derived from compression heating of the oxidant by an above-ground compressor (not shown). Second jacket 25 is also in indirect contact with the combustor unit 9 through supply line 3 and thus, the fuel receives further advantageous heat transfer.

In another important aspect of the invention, combustor unit 9 includes an inner combustor sleeve 29 having an inner wall 31 which defines a combustion zone 33. An intermediate sleeve 35 is spaced concentrically with respect to the inner combustor sleeve 29, and the space between the sleeves 29 and 35 defines an annular downward flow channel 37 serving as a heat transfer means for the inner combustor sleeve 29. The intermediate sleeve 35 has a portion 39 extending below the inner combustor sleeve 29. Extending portion 39 has an inner wall 41 which defines a steam generating zone 23.

An annular water spray ejector 45 is positioned between the intermediate sleeve 35 and the inner combustor sleeve 29. Water ejector 45 has a plurality of nozzles 47 (shown in FIG. 3) for ejecting water downwardly into the boundary 49 between the combustion zone 33 and the steam generating zone 23.

Further, in accordance with the invention, the combustor unit 9 includes a cylindrical housing sleeve 51 spaced concentrically with respect to the intermediate sleeve 35. The space between sleeves 51 and 35 defines an annular upward flow channel 53, which is connected to water supply line 21, and which serves as second heat transfer means. Upper annular reversing passage 55 connects the downward flow channel 37 with the upward flow channel 53. Together, the upward and downward flow of water serves to cool the inner combustor sleeve 29.

The apparatus of the invention is particularly useful for liquid propane gas as the fuel in conjunction with air as the oxidant; however, other combinations may be used.

Figure 2:
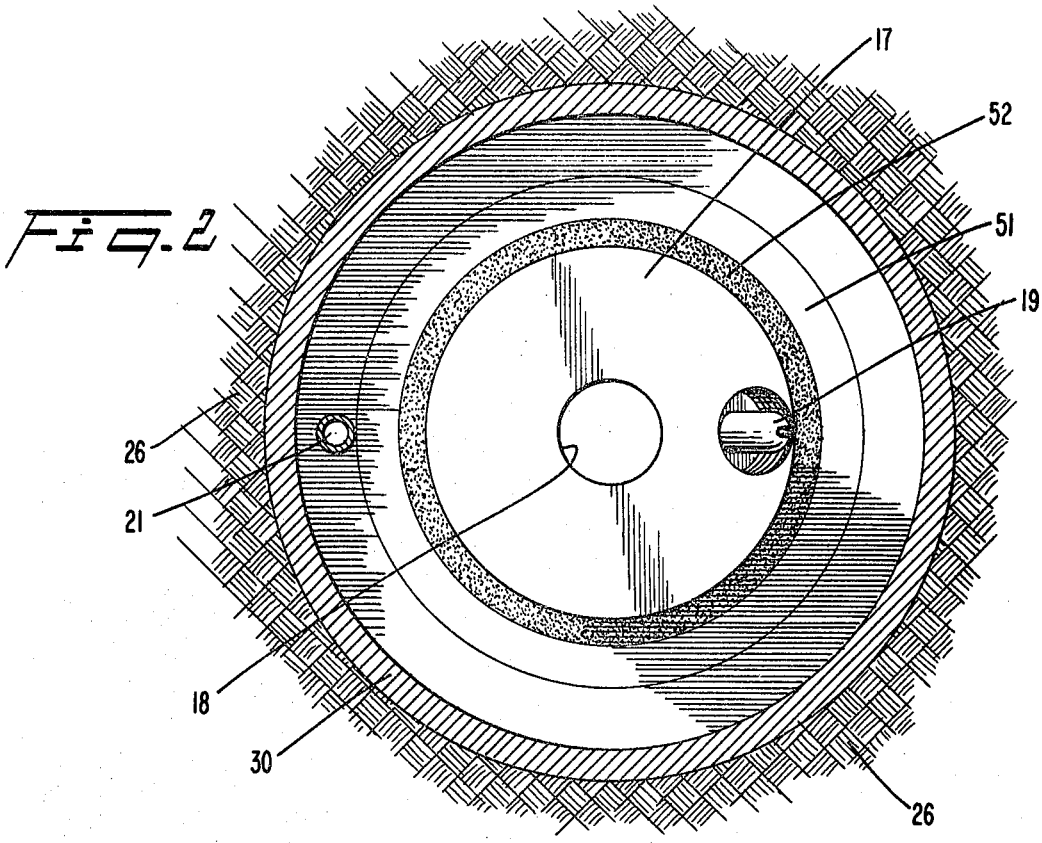
FIG. 2 is a lateral cross-section of the steam generator taken along lines 2—2 of FIG. 1.

As seen in FIGS. 1 and 2, looking down along plane 2—2, wedge weldment ring 52 secures housing 51 to top cap 17 in which inlet passage 18 is provided connecting fuel/oxidant mixing section 7 with combustion zone 33.

Figure 3:
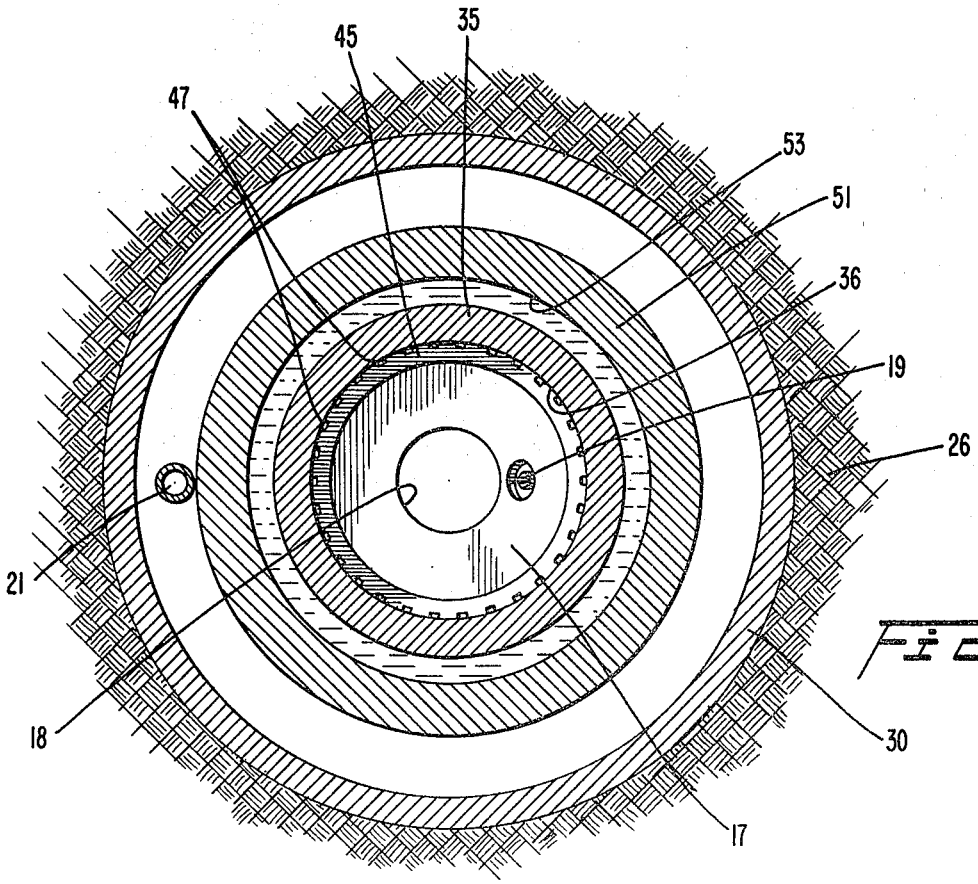
FIG. 3 is a lateral cross-section taken along lines 3—3 of FIG. 1.

FIG. 3 is taken along plane 3—3 looking upward in FIG. 1. Cylindrical housing sleeve 51 is spaced from intermediate sleeve 35 by upward flow channel 53. Annular water ejector 45, having a plurality of nozzles 47, is in contact with inner wall 36 of intermediate sleeve 35. Inlet passage 18 of top cap 17 is also visible in FIG. 3.

The inner combustor sleeve 29 is preferably fabricated from a material such as stainless steel, which is highly heat conductive and has considerable structural strength. The annular water ejector 45 is preferably a ring or rim on the lower end of inner combustor sleeve 29. A plurality of restrictive water nozzles 47 are machined in the circumference edge of the ring. Such a ring may be force-fitted onto inner combustor sleeve 29 or integral therewith.

Annular ejector 45, with its restrictive nozzles 47, serves an additional function in causing downward flow channel 37 to be completely filled with cooling water. Since downward flow channel 37 immediately surrounds and jackets inner combustor sleeve 29, complete filling of channel 37 with cooling water, and thereby removing air pockets, assures that inner combustor sleeve 29 is most efficiently cooled. If ejector 45 and its restrictive nozzles 47 were not present, water would stream down from passage 55 in downward flow channel 37 in unpredictable and inconsistent streams thereby precluding efficient heat transfer from the inner combustor sleeve to the water.

The pressure obtained downhole in the well casing where steam is applied to the formation is relatively high, for example, 500 p.s.i. This pressure is obtained throughout the entire well casing extending upwardly to the surface of the formation. Consequently, a tight seal must be obtained at the well head. For this purpose, casing cap 57 is provided.

Further details of construction of the combustor unit 9, as shown in FIG. 1, include bottom cap 24 supporting intermediate sleeve 35, which may be welded in place. Cylindrical housing sleeve 51 is force-fitted over flange 59 of bottom cap 24 and welded at ring 52*a*. At the bottom of top cap 17, inner combustor sleeve 29 is attached, such as by welding. By force-fitting flange 61 of top cap 17 into the top portion of cylindrical housing sleeve 51, and applying weldment ring 52, the final assembly of combustor unit 9 is obtained.

Annular passage 55 is defined by the clearance between top cap 17 and cylindrical intermediate sleeve 35. Adequate clearance must be provided at time of assembly so that the water flows freely into the channel 37 to maintain said channel completely filled and free of air pockets that could cause deterious hot spots.

It should be emphasized that the heat exchange jackets 15, 25 serve two functions. Primarily they serve to transfer heat from the combustor unit 9, in the case of jacket 15, and from the oxidant supply line 3, in the case of jacket 25, to preheat the liquid propane fuel. Secondarily, they serve to cool these precombustion areas, thereby precluding unwanted burnback. Similarly, the dual function of the counterflow water channels 53, 37 preheating the water for forming steam at the nozzles 47, and cooling the combustor sleeve 29, is a notable advance over the prior art.

From the foregoing, and in summary, it is evident that numerous benefits and advantages are obtained by using the apparatus of the invention. Use of jackets 15 and 25 serve to preheat liquid fuel, preferably converting the fuel to a vapor, prior to combustion, and in addition, serve to cool precombustion areas, thereby preventing burnback. Countercurrent water flow through annular water flow channels 53 and 37 serve to provide efficient and effective cooling of inner combustor sleeve 29, thereby preventing its deterioration. Annular water ejector 45, having a plurality of nozzles 47, receives preheated water from channel 37 and generates high velocity steam directed toward the nozzle 22 where the velocity is further increased.

The nozzles 47 are at the bottom of the inner combustor sleeve 29 forming the combustion zone 33, thereby preventing water from quenching the flame, and also prevents wetting of ignitor 19. Annular ejector 45 ejects water downwardly only into steam generating zone 23. This allows complete combustion of the fuel with oxidant prior to injection of water into the hot combustion products. The water is ejected into the outer boundary layer of the combustion products, thus accelerating the flow in this critical area and causing the water to flash to steam. In this manner, maximum use is made of the heat of combustion for vaporizing the injected water to form high enthalpy steam.

The foregoing descriptions of embodiments of the method and apparatus of the invention have been provided for purposes of illustration and description. It is not intended to be exhaustive or to limit the invention to the precise forms disclosed. Obvious modifications and varifications are possible in light of the above teaching.

The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. An apparatus for downhole steam generation, comprising an oxidant supply means for supplying oxidant downhole;

a combustion assembly adaptable for being lowered downhole and comprising a fuel/oxidant mixing section, a combustor unit and a top cap member made of heat conductive material for operably connecting the fuel/oxidant mixing section to the combustor unit;

a fuel supply means for providing fuel to said fuel/oxidant mixing section and comprising a first heat exchanger jacket made of heat conductive material surrounding the fuel/oxidant mixing section and secured to the top cap member and having a fuel inlet port for receiving fuel therein, and a second heat exchanger jacket in communication with the first heat exchanger jacket, said second heat exchanger jacket surrounding the fuel/oxidant mixing section and having a fuel outlet port in communication with the fuel/oxidant mixing chamber;

an ignitor means connected to said combustor assembly for igniting the fuel/oxidant; and water supply means completely surrounding and operably connected to said combustor unit for providing water to be converted to steam by the heat of combustion of the fuel/oxidant.

2. An apparatus for downhole steam generation as described in claim 1, wherein said oxidant supply means is constructed of heat conductive material, and directly contacts said top cap member, thereby providing heat conductive from said top cap member to the fuel in said first and second jackets.

3. An apparatus for downhole steam generation comprising:

a combustor assembly having a fuel/oxidant mixing section and a combustor unit;

an oxidant supply means connected to said fuel/oxidant mixing section;

a fuel supply means connected to said fuel/oxidant mixing section;

an ignitor means connected with said combustor unit;

a water supply means connected to said combustor unit for providing water to be converted to steam by the heat of combustion of the fuel/oxidant;

said combustor unit including an inner combustor sleeve having an inner wall defining a combustion zone;

an intermediate sleeve spaced concentrically with respect to said inner combustor sleeve, the space between said intermediate sleeve and said inner combustor sleeve connected to said water supply means and defining an annular water flow channel for said inner combustor means, said intermediate sleeve having a portion extending below said inner sleeve, said extending portion having an inner wall defining a steam generating zone; and a water ejector means for controlling the flow of water through the annular water flow channel and comprising an annular spray injector member positioned between the lower end of the inner combustor sleeve and the intermediate sleeve said annular spray injector member comprising a plurality of spaced apertures around the outer periphery of said annular spray injector member adjacent the intermediate sleeve for ejecting said water downwardly along the inner wall of said intermediate sleeve, said annular spray injector member being capable of restricting the flow of water therethrough to ensure the continuous and even distribution of water throughout said water flow channel.

* * * * *

UNITED STATES PATENT AND TRADEMARK OFFICE

CERTIFICATE OF CORRECTION

PATENT NO. : 4,411,618

DATED : October 25, 1983

INVENTOR(S) : Donaldson et al.

It is certified that error appears in the above-identified patent and that said Letters Patent is hereby corrected as shown below:

In the title page at block [75], the inventor Mulac was omitted.

Block [75] should read as follows:

A. Burl Donaldson; Donald E. Hoke,
both of Albuquerque, NM; and
Anthony J. Mulac, of Tijeras, NM.

Signed and Sealed this

*Twenty-fourth* Day of *July 1984*

[SEAL]

*Attest:*

GERALD J. MOSSINGHOFF

*Attesting Officer*

*Commissioner of Patents and Trademarks*